United States Patent [19]

Berntell

[11] 4,069,671

[45] Jan. 24, 1978

[54] STIRLING ENGINE COMBUSTION ASSEMBLY

[75] Inventor: John Osvald Berntell, Malmo, Sweden

[73] Assignee: Kommanditbolaget United Stirling (Sweden) AB & Co., Malmo, Sweden

[21] Appl. No.: 702,092

[22] Filed: July 2, 1976

[51] Int. Cl.[2] ..... F02G 1/00

[52] U.S. Cl. ..... 60/525; 60/526

[58] Field of Search ..... 60/517, 524, 525, 526

[56] References Cited

U.S. PATENT DOCUMENTS

| | | | |
|---|---|---|---|
| 3,863,452 | 2/1975 | Asselman et al. | 60/524 |
| 3,890,785 | 6/1975 | Torsten | 60/525 |
| 3,940,934 | 3/1976 | Hakansson | 60/526 X |
| 3,991,457 | 11/1976 | Barton | 60/517 X |

*Primary Examiner*—Allen M. Ostrager
*Assistant Examiner*—Stephen F. Husar
*Attorney, Agent, or Firm*—Laurence R. Brown

[57] ABSTRACT

In a double-acting multi-cylinder V-configuration Stirling cycle engine having a single burner unit, the regenerator-cooler units are clustered around a central axis of the heater head with radially extending heater pipes to keep manifold volumes small and temperatures on the heater pipes high.

4 Claims, 2 Drawing Figures

STIRLING ENGINE COMBUSTION ASSEMBLY

This invention relates to a double-acting multi-cylinder Stirling-cycle hot gas engine of the kind (herein called "the kind defined") comprising a heater head in which is a single combustion chamber for heating a plurality of heater pipes connecting the hot expansion chambers of the cylinders to the regenerators of respective regenerator-cooler units. Usually the combustion chamber is provided with a single burner unit, which is most conveniently co-axial with the heater head.

It is known to construct engines of the kind defined with the regenerator-cooler units mounted either between the cylinders at approximately the same radial distance as the cylinders from the central axis of the heater head or mounted at a greater radial distance than the cylinders from the said central axis.

In Stirling cycle hot gas engines heat is supplied through the walls of the heater pipes of the heater head to charges of working gas each passing to-and-fro between a hot expansion space and a cool compression space through the repective heater pipes and the respective regenerator-cooler units. During gas flow in the direction from the heater head to the cooler the heated working gas will give off heat to the regenerator. Said heat is stored in the regenerator and returned to the working gas when the latter has reversed its direction.

In order to obtain a high efficiency it is important that "dead-volumes" such as manifolds are kept as small as possible and that the regenerator top and the adjacent parts of the heater pipes are located at places in the combustion chamber where high temperatures prevail.

According to the present invention a hot gas engine of the kind defined is characterised in that the regenerator-cooler units are clustered around a central axis of the heater head, and the expansion chambers of the cylinders are located at greater radial distances than the regenerators from the said axis.

Preferably the heater pipes have portions which extend approximately radially outwards with respect to the said axis from the regenerators.

In a compact construction the heater pipe portions which extend approximately radially outwards are substantially coplanar with each other.

Advantageously there is a single burner unit which is located at the part of the combustion chamber opposite to the heater pipe portions which extend approximately radially outwards, the burner unit being arranged to direct combustion gases towards the said pipe portions.

In a preferred engine the cylinders are disposed in V-configuration and the pistons therein are connected to a common crank-shaft, and the burner unit is arranged to direct hot combustion product towards the crank-shaft axis.

It is convenient if the regenerator-cooler units are mounted in a common housing.

Figure 1:
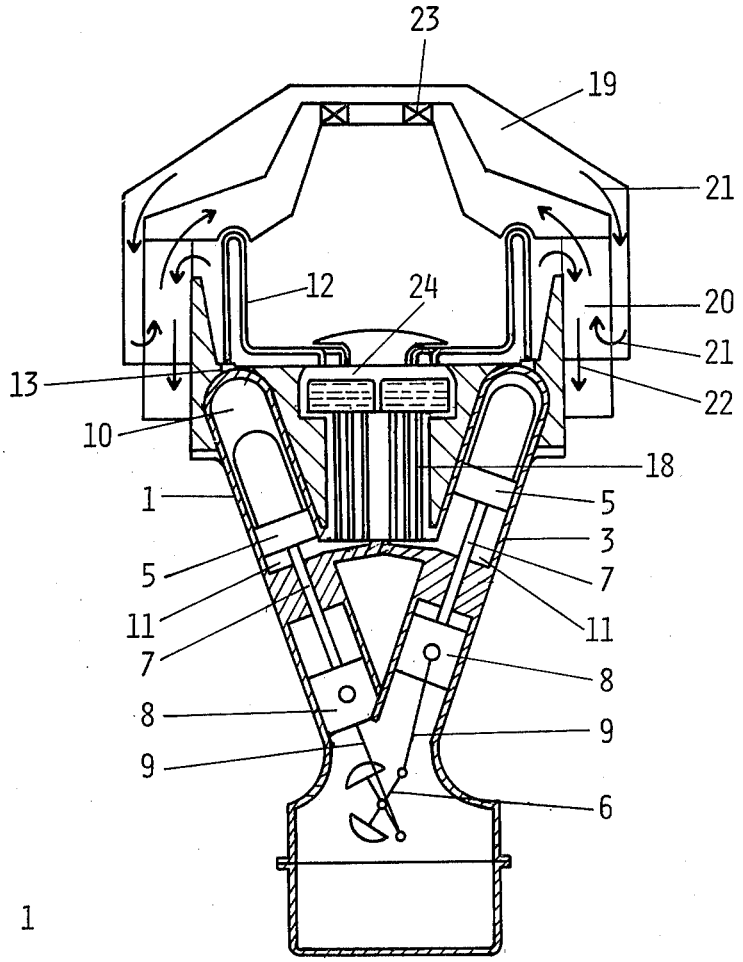
Figure 2:
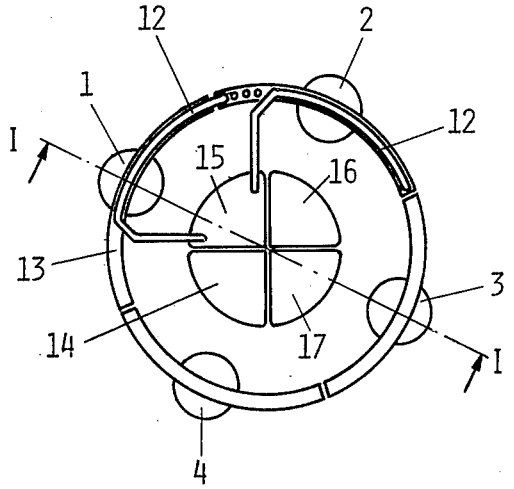

How the invention may be put into practice is described in more detail with reference to the accompanying drawing, in which FIG. 1 schematically shows a vertical section of a Stirling cycle hot gas engine according to the invention, the said section being taken along the line I—I of FIG. 2, and FIG. 2 schematically shows connections between the cylinders and regenerators as viewed from above.

The illustrated engine comprises four cylinders 1–4 in each of which reciprocates a piston 5 connected to a crank-shaft 6 via a respective piston rod 7, a respective cross-head 8, and a respective connecting rod 9. The piston 5 of the cylinder 1 divides the interior of the cylinder 1 into an upper hot expansion space 10 and a lower cool compression space 11.

Heater pipes 12 are connected to the upper space 10 of the cylinder 1 via a manifold 13, and connect the upper space 10 with the top of a regenerator 14. Other heater pipes 12 connect the upper end of the cylinder 2 with a regenerator 15, the cylinder 3 with a regenerator 16, and the cylinder 4 with a regenerator 17.

The four regenerators 14 – 17 are shaped as segments of cylinders and are mounted so that they are clustered around a central axis of a heater head in which is a single combustion chamber. Thus the regenerators, each with a respective cooler 18, are located centrally relative to the cylinders 1–4, which are disposed to form a V-engine. The pipes 12 extend outwardly from the regenerators, without need of manifolds at their inner ends connected to the regenerators.

Each regenerator 14 – 17 is at the top of the regenerator-cooler unit comprising the respective cooler 18, and the gas from the coolers may pass into the respective lower spaces 11 under the pistons 5.

Air for combustion is blown (by means not shown) into a chamber 19 at the top of the heater head of the engine and flows into a heat-exchanger 20, as indicated by arrows 21. Here the air is preheated by a flow of hot exhaust gases (shown by arrows 22) and the preheated air is used for combustion with fuel supplied to a burner 23. The hot combustion products and radiated flame heat will give off heat to the pipes 12 and leave the engine via the preheater as shown by the arrows 22.

The regenerators 14 – 17 shown as individual units in FIG. 2 may be arranged in a common housing 24 as shown in FIG. 1, but within said housing 24 the working gas must flow separately in each regenerator.

It will be understood that the illustrated engine is of the kind defined and there are four separate charges of working gas, of which one flows to-and-fro between the space 10 of the cylinder 1 and the space 11 of the clyinder 2 via pipes 12 and manifold 13 and regenerator 14 and a cooler 18, and the other three charges flow analogously.

FIG. 2 shows only two of the heater pipes 12 which extend from the manifold at the top of the cylinder 2 to the top of the regenerator 15. For the sake of clarity all the other numerous heater pipes are omitted from FIG. 2, and likwise only two heater pipes are shown in FIG. 1.

As shown the expansion chamber 10 the the cylinders 1–4 are located at greater radial distances than the regenerators 14–17 from the said axis, and the heater pipes 12 have portions which extend approximately radially outwards with repect to the said axis from the regenerators 14–17. Those heater pipe portions which extend approximately radially outwards are substantially coplanar with each other, and there is a single burner unit 23 which is located at the part of the combustion chamber opposite to the heater pipe portions which extend approximately radially outwards, the burner unit 23 being arranged to direct combustion gases towards the said pipe portions.

The cylinders 1–4 are disposed in V-configuration and the pistons therein are connected to a common crank-shaft 6 and the burner unit 23 is arranged to direct hot combustion products toward the crank-shaft axis.

What is claimed is:

1. A multiple-cylinder double-acting hot gas engine having a single burner unit having a plurality of regenerator-cooler units interconnected with respective ones of said cylinders by heater pipes wherein the burner unit has a heater head disposed about a central axis to direct combustion gases toward said heater pipes, wherein said cylinders are disposed about said central axis with said regenerator-cooler units clustered around said central axis inside said cylinders, and wherein the regenerator-cooler units are mounted in a common housing.

2. A hot gas engine according to claim 1, wherein the heater pipes have portions which extend approximately radially outwards with respect to the said axis from the regenerators.

3. A hot gas engine according to claim 2, wherein the heater pipe portions which extend approximately radially outwards are substantially co-planar with each other.

4. A hot gas engine according to claim 1, wherein the cylinders are disposed in V-configuration and the pistons therein are connected to a common crank-shaft, and the burner unit is arranged to direct hot combustion products towards the crank-shaft axis.

* * * * *